United States Patent [19]

Adam

[11] Patent Number: 4,836,613

[45] Date of Patent: Jun. 6, 1989

[54] CUTTERHEAD FOR WATER JET ASSISTED CUTTING

[76] Inventor: Roger F. J. Adam, 1351 Washington Rd., Pittsburgh, Pa. 15228

[21] Appl. No.: 146,305

[22] Filed: Jan. 21, 1988

Related U.S. Application Data

[63] Continuation-in-part of Ser. No. 658,982, Oct. 9, 1984.

[51] Int. Cl.[4] ..... E21C 35/22; E21C 35/20

[52] U.S. Cl. ..... 299/81; 299/17; 299/45

[58] Field of Search ..... 299/81, 45, 17, 16; 92/57, 153; 91/499, 501

[56] References Cited

U.S. PATENT DOCUMENTS

| | | | |
|---|---|---|---|
| 2,901,979 | 9/1959 | Henrichsen | 91/488 |
| 3,563,324 | 2/1971 | Lauber | 175/393 |
| 3,773,384 | 11/1973 | Anderson | 299/76 |
| 3,783,744 | 1/1974 | Benkovic | 92/57 |
| 3,904,246 | 9/1975 | Gandy et al. | 299/81 |
| 4,049,318 | 9/1977 | Fruin | 299/81 |
| 4,068,894 | 1/1978 | Dring | 299/45 |
| 4,212,497 | 7/1980 | Borowski et al. | 299/81 |
| 4,268,089 | 5/1981 | Spence et al. | 299/87 |
| 4,346,939 | 8/1982 | Krause | 299/45 |
| 4,368,925 | 1/1983 | Honke | 299/45 |
| 4,534,597 | 8/1985 | Kemper | 299/81 |
| 4,569,558 | 2/1986 | Hood | 299/81 |

FOREIGN PATENT DOCUMENTS

| | | | |
|---|---|---|---|
| 3144741 | 5/1983 | Fed. Rep. of Germany | 299/81 |
| 604996 | 4/1978 | U.S.S.R. | 299/45 |
| 777213 | 12/1980 | U.S.S.R. | 299/81 |
| 2066873 | 7/1981 | United Kingdom | 299/45 |

*Primary Examiner*—Hoang C. Dang

*Attorney, Agent, or Firm*—William J. Ruano

[57] ABSTRACT

An integrated cutterhead for water jet assisted cutting which can be retrofitted to an existing machine by replacing its cutterhead. The pressure of the water supplied is intensified inside the cutterhead itself up to the level required for jet assist cutting by an even number of independent cylinders mounted inside the rotating drum, parallel to its axis. Each cylinder is afferent to one sector of the cutterhead. A stationary cam controlling the cylinders stroke can be adjustably rotated to adapt the distribution of high pressure water to the direction of the cutting operations. The cam is designed preferably as to make the water pressure of the jet correspond to the cutting depth of the cutting tool. This arrangement limits the high pressure water area to the drum of the cutterhead and does not require high pressure valves and distributors.

4 Claims, 4 Drawing Sheets

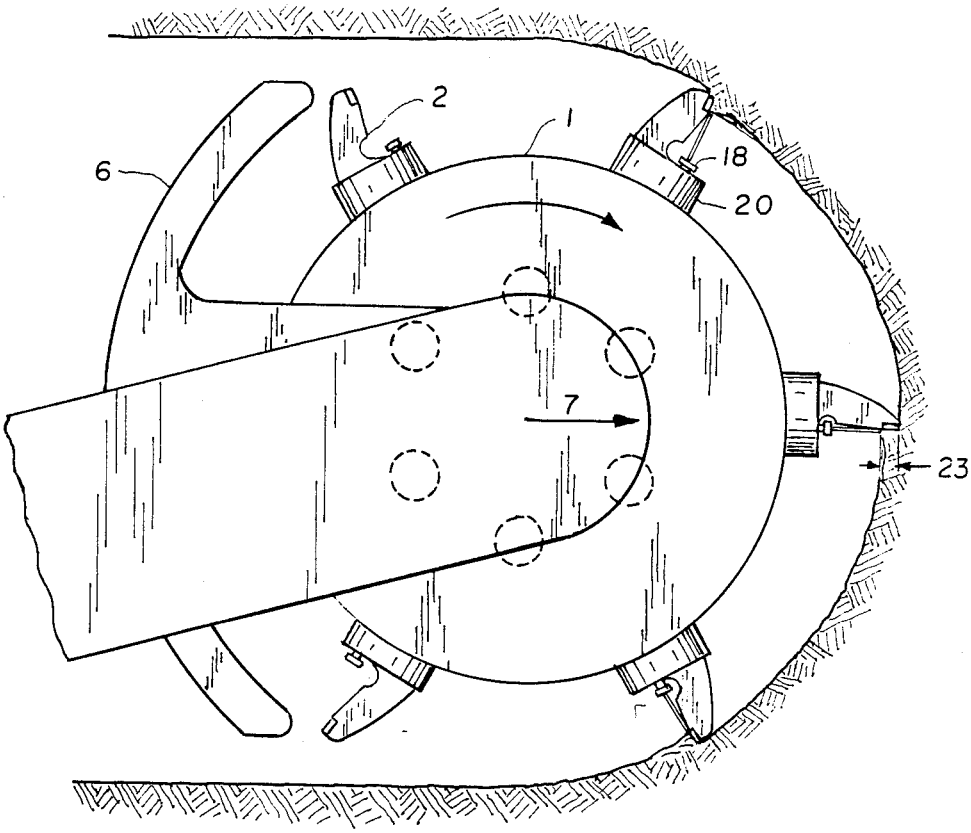
Fig.2
Fig.3a
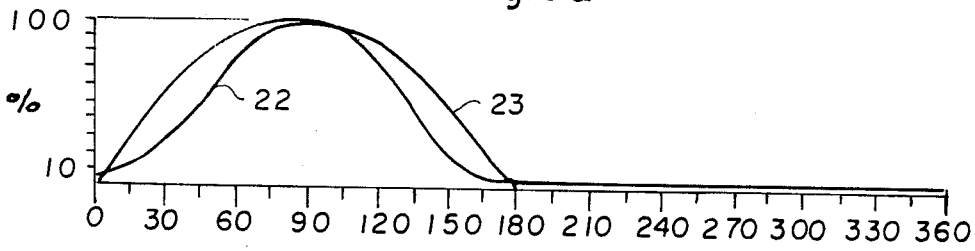
Fig.3b
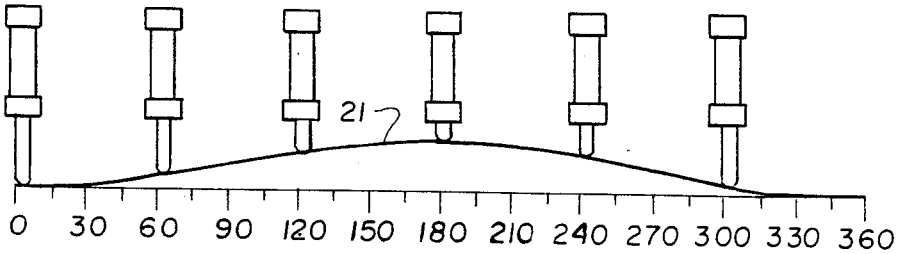

CUTTERHEAD FOR WATER JET ASSISTED CUTTING

This application is a C.I.P. of Application Ser. No. 06/658,982, filed 10/9/84.

This invention relates to an integrated cutterhead for water jet assist cutting.

BACKGROUND OF THE INVENTION

A cutterhead with water jet assist cutting uses the action of a high pressure water jet directed towards the tip of each cutting tool to reduce mechanical cutting forces, tool wear, dust production and risk of methane ignition. Tests have demonstrated that a maximum efficiency of the water jet action is obtained when the depth of the groove made by the jet equals the cutting depth of the cutting tool or is slightly inferior to it. The depth of the groove created by a waterjet is a function of the water pressure. Therefore, water pressure should vary in relation with the tool depth of cut.

Current state of the art has shown the development of water jet assist cutting technique to be limited by the reliability and maintainability of high pressure equipment, flexible hoses, valves, distributors, and rotating seals. Solutions to supply high pressure water to the operating cutting tools only, which is essential for safety purposes and for limiting the power requirements, are complex and their life expectancy is not satisfactory. Sectorial distribution should be easily and quickly modified when the cutting direction changes.

In addition to these technical problems, there is no current solution to adapt the water pressure to the variable cutting depth of the tools.

SUMMARY OF THE INVENTION

An object of the present invention is to limit the high pressure water area to the rotating drum of the cutterhead to eliminate maintenance and safety problems associated with high pressure valves, rotating seals, and high pressure flexible hoses.

Another object is to limit the supply of high pressure water to the tools actualy cutting and to provide an automatic change of the high pressure distribution when the direction of cutting operations is inverted.

A more specific object is to adapt the water pressure of the jets to the cutting depth of the associated tool, depth of cut which varies during the cutterhead rotation.

Another advantage of the invention in limiting the high pressure water area to the cutting drum is that a machine can be adapted to water jet assist cutting by simply replacing its cutterhead by the integrated cutterhead as hereafter described.

An additional advantage of the invention in the case of multi section cutterhead is that high pressure water jets can be used to cut areas cutting tools cannot reach.

Objects and advantages of the invention will become more apparent from the following description of an application to a cutterhead with the accompanying drawings, wherein;

BRIEF DESCRIPTION OF THE DRAWINGS

FIG. 2 is a front view of the drum assembly shown on FIG. 1.

FIG. 3*a* is a representation of the pressure curve of one cylinder related to a planar cam inclined on the drum axis, compared to the cutting depth of a tool.

FIG. 3*b* shows the development of the cam and the corresponding displacement of the plungers.

DESCRIPTION OF THE PREFERRED EMBODIMENT

Figure 1:
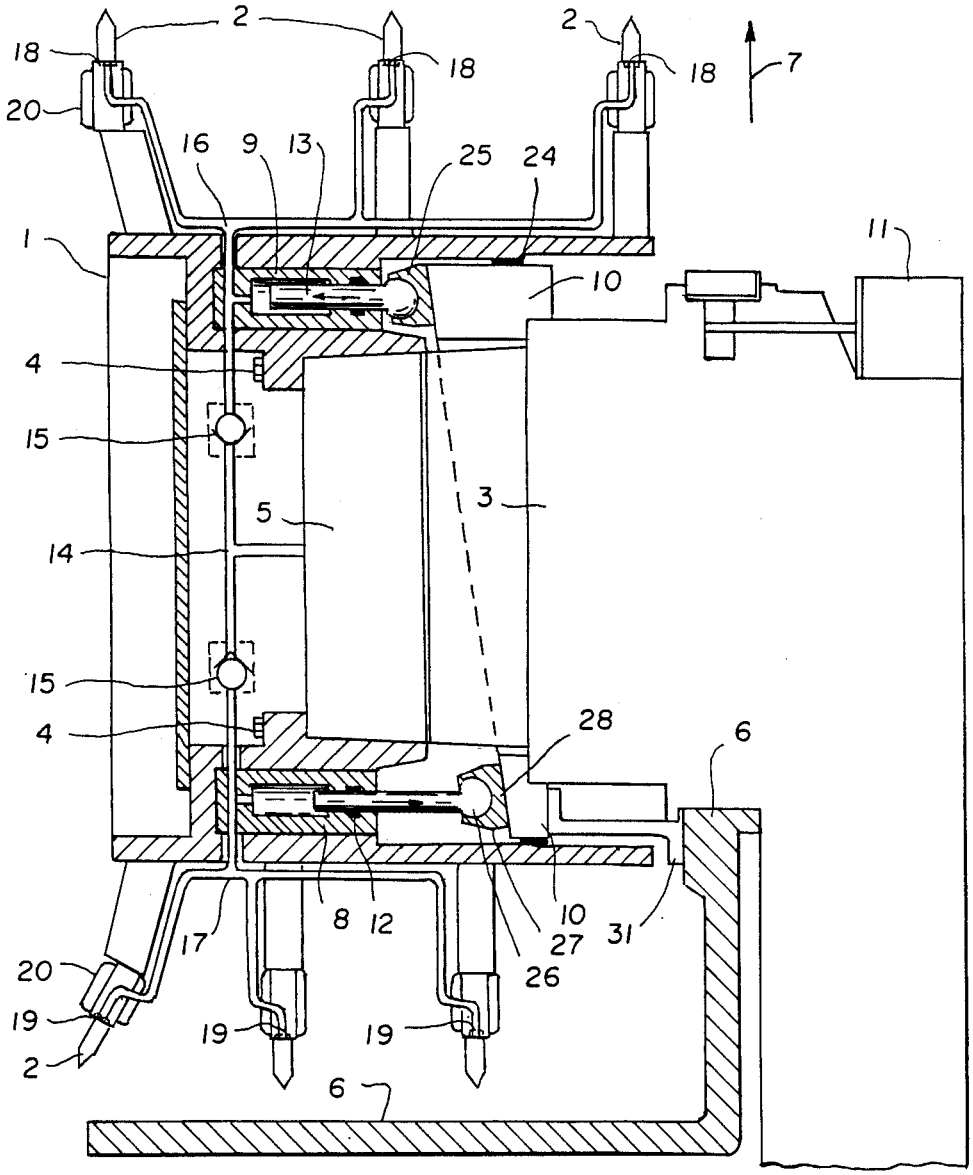
FIG. 1 is a cross-section of a shearer loader cutting drum showing plungers and cylinders for pressure intensification with the cam and its rotation system.

Referring more particularly to FIG. 1, the drum 1 equipped with cutting tools 2 rotates around a gear box 3 and is fixed by screws 4 to the rotating end 5 of the gear box 3. The drum is partially enveloped by a cowl 6 on the free side of the drum opposite the cutting direction 7.

According to the present invention, hydraulic cylinders such as the cylinders numbered 8, and 9 are fitted to the drum 1 on its inside. An annular cam 10 is set against the non rotating part of the gear box 3.

Cylinders 8 and 9 are represented in a cross-section showing plungers 12 and 13. The inlets of the cylinders 8 and 9 are connected to the low pressure water supply outlet 14 located on the rotation axis of the gear box 3 through admission valves 15. The cylinders outlets 16 and 17 are each independently connected by piping to nozzles 18 and 19 located in front of cutting tools 2 each fixed in a tool box 20 welded to the drum 1. Each cylinder is connected to a group of nozzles located in a sector area of the drum.

The high pressure P on the outlet side 16 of the cylinder 9 results from the pressure drop through the nozzles 18 and is related to the flow Q according to the relations:

$$P=\tfrac{1}{2}pV^2$$

p water specific mass
r nozzle radius $$Q=NK.\pi r^2V$$

k coefficient of discharge
N number of nozzles per cylinder
V water speed through the nozzles FIG. 3*a* is a representation of the pressure curve 22 of one cylinder and of the depth of cut of an associated tool in percentage of the maximum values for a 360 degrees rotation of the drum 1 assuming a planar cam; pressure is increasing when tool is cutting to reach its peak when the cutting depth of the tool is at maximum value as shown on FIG. 2, front view of drum 1.

FIG. 3*b* is a representation of the cam development 21 and the relative positions of a six cylinders set.

The peak pressure is obtained when the plunger displacement reaches the maximum speed which depends on the cam position. The cam is first set in such a position that each cylinder will start pumping water out when the corresponding tools start cutting and reach the maximum pressure when the depth of cut of the associated tool is maximum. However, in most cases the cutting direction changes and the cam must rotate accordingly. As represented on FIG. 1, the hydraulic motor 11, through gearing is used to rotate cam 10 when the cutting direction changes. The same system can be used to rotate, simultaneously, cam and cowl, when a cowl is used because both cam and cowl have to be rotated the same angle when cutting direction changes. A connection 31 is represented between cowl 6 and cam 10. When no cowl is used motor 11 will rotate only the cam.

The displacement of the plungers 12, 13 resulting from the action of the cam 10 can be obtained by fitting the spherical end 26 of the plungers 12,13 with shoes 27 sliding on a planar cam 10. That arrangement provides the simplest form of construction. But the high pressure required for efficiently assisting a cutting tool with a water jet results in a high contact pressure at the interface between shoe 27 and cam 10. Such a pressure combined with a high linear speed as found in most of cutting drums requires hydrodynamic lubrication of this interface. When shoes are made of usual metals, such brass or bronze, hydrodynamic lubricationis obtained by injection of oil through the shoe; that is common practice in the design of hydraulic pumps and motors but it is not well adapted to the operating conditions of a cutting drum.

Figure 4:
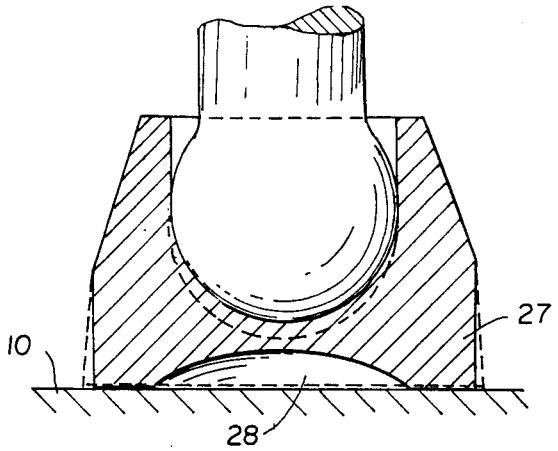
FIG. 4 represents a flexible shoe fitted to the end of the plunger and sliding on the cam.

According to the present invention as represented in an enlarged view on FIG. 4, the shoes 27 are made of a flexible material and shaped to maintain a cavity 28 between shoe 27 and cam 10 when there is no or little force pressing the shoe against the cam; but, when the pressure intensifier operates, the pressure fluctuates inside the cylinders as represented on FIG. 3*a*. The design of the shoe and its elastic flexibility allow for the elastic deformation of the face applied against the cam alternatively ejecting the lubricant from and sucking it into the said cavity. This action results in a hydrodynamic lubrication of the interface between shoe 27 and cam 10. The calculation of the elastic deformation of the shoe at each cycle takes in account the elasticity limit and the flexural fatigue of the material to keep the stress in an acceptable range. Deflection can be calculated by assimilating the shoe to a circular plate supported at its edge. The formula is:

$$D = 0.221 \frac{W * R^2}{E * t^3}$$

W total uniform load in pounds
R plate radius in inch
t thickness in inch
E=450,000

Figure 5A:
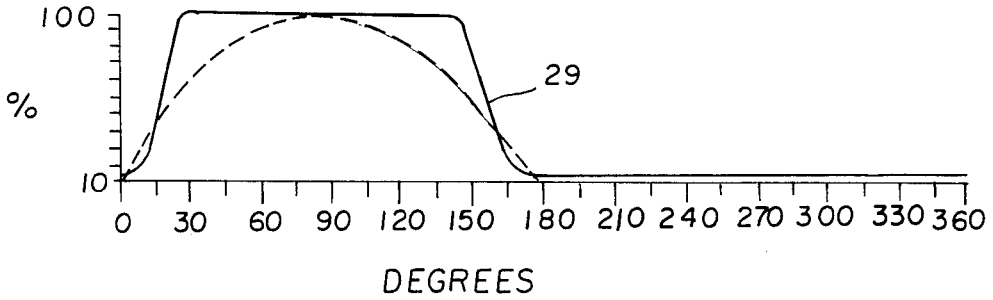
FIGS. 5*a* and 5*b* illustrate another application of flexible shoes to non planar cams showing the pressure curve corresponding to a skew surface on which the plunger head follows a double spiral curve
Figure 5B:
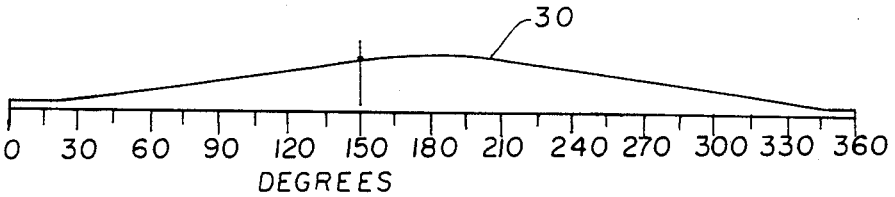

The shoe flexibility which, in the latter example, was used for creating an hydrodynamic lubrication of the interface can also allow for the use of a non planar cam which can be designed for different pressure curves if necessary, such as cam development 30 represented on FIG. 5*b* with the corresponding pressure curve 29, represented on FIG. 5*a*. In this example, the plunger head follows an ascending spiral curve followed by a descending spiral curve which are represented by straight lines on the cam development shown on FIG. 5*b*. Except on the connection between these two spirals the plunger moves at a constant speed resulting in a constant water pressure as shown on FIG. 5*a*.

The pressure intensifier represented on FIG. 1 is built-in inside a cutting drum 1, which operates half buried in cutting chips and dust, is protected against the introduction of dust by a double seal 24. This seal could not be efficient in the case of any volume variation of the drum internal cavity 25 surrounding the plungers, because any variation of the volume of said cavity will result in a destructive introduction of fine products. According to the invention, an even number of cylinders is used with a regular distribution in such a manner that when a plunger 12 is extending out of its cylinder 8, the diametrically opposed plunger 13 retracts at the same speed leaving no possibility for a volume variation of the drum internal cavity.

When the cutterhead is composed of several sections, the invention presents the same advantages pertaining to an internal water pressure built up and a favorable sectorial water distribution; but the latter advantage requires the use of one set of cylinders and cam per section. Differences are in the low pressure water supply, which requires at least one large diameter rotating seal, in the absence of cowl and, in the cutting direction changes which are limited to 90 degrees.

Figure 6:
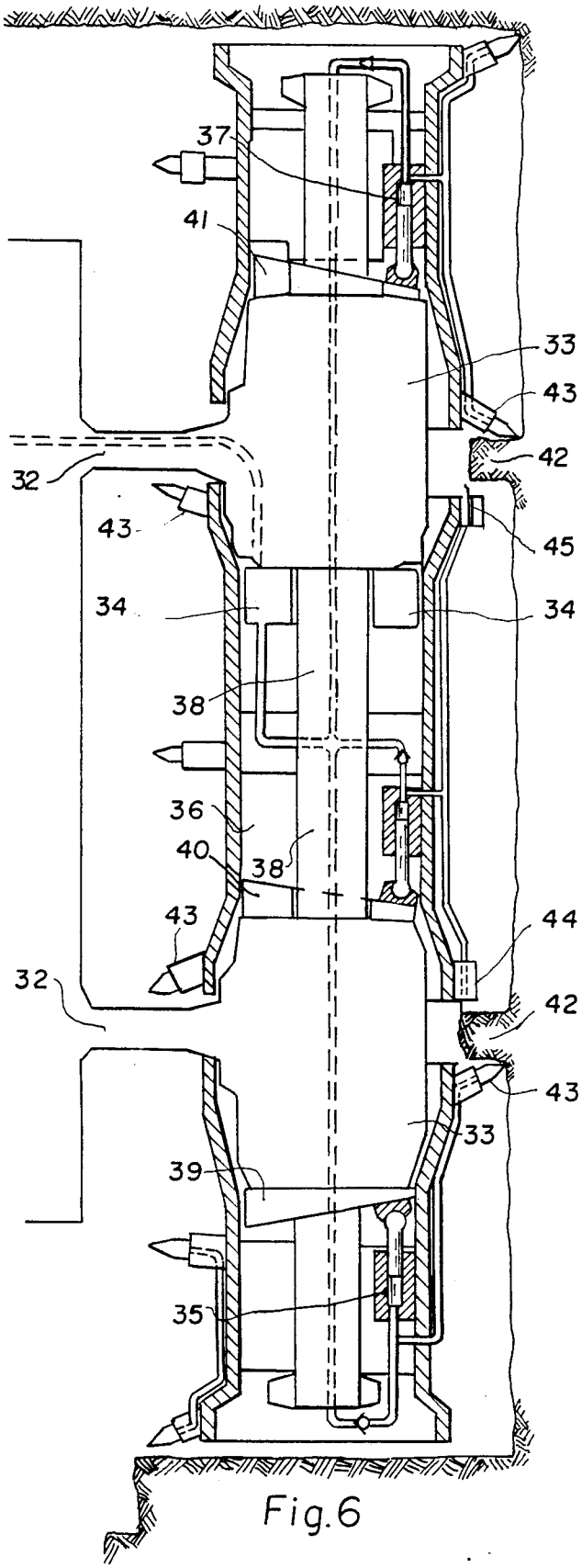
FIG. 6 shows the location of auxiliary water jet nozzles to cut the cores left between cutterhead sections of a three sections cutter head.

FIG. 6 shows an aplication of the invention to a cutterhead having two intermediate drives and supports 32 which results in two gear boxes 33 and three cutting drum sections. Low pressure water is supplied through support 32, gear box 33 to the rotating seal 34 and from there to the three sets of cylinders 35, 36, 37 through the common shaft 38. Arrangement of cylinders 35, 36, 37 and cam 39, 40, 41 is similar, in each section, to the arrangement described in the application to one section cutterhead.

When the cutterhead is composed of several sections as shown on FIG. 6, supported and driven at intermediate locations 32 because the cutterhead ends are both used for cutting, cores 42 are left by cutting tools 43 between cutterhead sections. In favorable cases the cores break, but when the material to cut is relatively hard, these cores 42 can impede machine advance and cutting operations. The cores cannot be cut by mechanical tools 43 without interfering with the cutterhead supports 32 when the cutterhead sections have the same rotation axis as represented on FIG. 6. According to the present invention, auxiliary high pressure water jets 44,45 are used to cut these cores 42. High pressure water is produced by the built-in pressure intensifier to assist the cutting tools. Part of this high pressure water supply can be made available for these auxiliary water jets. As represented on FIG. 6, the said auxiliary jets 44,45 will be located at the inner end of the cutter head sections and oriented parallel to the cutting head axis. These water jets will be very efficient because a short stand off distance is possible wih the nozzle very close to the core to be cut and because it is possible to use powerful jets due to the small number of jets required. As another advantage, these jets 44,45 will be operating only when passing in front of the core 42 and will be inactive when passing in front of the support 32 according to the flow curves shown on FIGS. 3a or 5a and typical of the invention.

While I have illustrated and described two embodiments of my invention, it will be understood that they are by way of illustration only and that various changes and other modifications are contemplated by my invention within the scope of the following claims.

I claim:

1. A cutter head for water jet assisted cutting comprising at least one generally cylindrical and rotatable drum having a plurality of cutting tools mounted externally thereof, each having a water jet nozzle directing a high pressure water jet outwardly and directly to the tip of the said tools to assist mechanical action, means including an even number of hydraulic cylinders and corresponding plungers mounted on the inside of and rotatable with said drum, a stationary but rotatably adjustable annular cam coaxial with said drum and having an annular camming surface, said hydraulic cylinders and corresponding plungers having axes parallel to the axis of said drum, each of said plungers having one end reciprocating in the associated cylinder and the other end fitted with a flexible shoe engaging said camming surface, the plungers reciprocating movement being controlled by the cam through said flexible shoes, said flexible shoes having a cup shaped sole having an external cavity containing lubricant and designed such that the cup shaped sole is elastically flattened against the cam surface at least once at each drum revolution to create an hydrodynamic lubrication of the interface between the cam and shoe by alternatively sucking surrounding lubricant into the cup shaped sole cavity of the shoe when the pressure on the shoe is released and ejecting said lubricant when the pressure on the shoe increases.

2. A cutterhead as recited in claim 1 in which the cylinders in even number are contained in an internal cavity of said drum and are symetrically arranged around the drum axis to prevent any variation of volume of said cavity which encloses the plungers, the movement of one plunger being exactly compensated by the opposite movement of the diametrically located plunger so as to permit an efficient sealing of the said cavity and its filling with a lubricant.

3. A cutterhead as recited in claim 1 in which the plungers reciprocating movement is controlled by the said annular cam through said flexible shoes, elastic deformation of said shoes permitting the use of non planar cams having a skew camming surface.

4. A cutterhead for water jet assist cutting as recited in claim 1, comprising a plurality of interconnected rotatable coaxial cutting drums mounted on a common shaft, the said shaft being supported by and driven through intermediate supports, additional cutting water jets are located on said drum at the end of each drum next to an intermediate support and oriented parallel to the cutter head shaft axis to cut cores left by the cutting tools between the said cutting drums in front of the cutter head intermediate supports, said additional water jets which are not assisting a cutting tool, having the same high pressure water supply as jets assisting tools have and providing water only when jets adjacent to said additional jets are cutting.

* * * * *